US006595381B1

(12) United States Patent
Johnson

(10) Patent No.: US 6,595,381 B1
(45) Date of Patent: Jul. 22, 2003

(54) CONTAINER METHOD AND APPARATUS

(76) Inventor: Cora Johnson, 205 Cloister La., Aptos, CA (US) 95003

( * ) Notice: Subject to any disclaimer, the term of this patent is extended or adjusted under 35 U.S.C. 154(b) by 0 days.

(21) Appl. No.: 09/436,333

(22) Filed: Nov. 8, 1999

(51) Int. Cl.[7] ..... B65D 25/00
(52) U.S. Cl. ..... 220/345.1
(58) Field of Search ..... 220/345.1, 23.83, 220/23.86, 771

(56) References Cited

U.S. PATENT DOCUMENTS 466,416 A * 1/1892 Hunt ..... 220/345.1 X
1,696,456 A * 12/1928 Sebring ..... 220/345.1 X
2,478,470 A * 8/1949 Eastman et al. ..... 220/345.1 X
2,562,248 A * 7/1951 Weed ..... 220/345.1
2,619,251 A * 11/1952 Schmidt ..... 220/771 X
3,164,428 A * 1/1965 Kesh ..... 220/345.1 X
3,182,856 A * 5/1965 Goltz ..... 220/345.1 X
3,647,102 A * 3/1972 Cooley ..... 220/345.1 X

* cited by examiner

*Primary Examiner*—Steven Pollard
(74) *Attorney, Agent, or Firm*—George E. Kersey

(57) ABSTRACT

Apparatus and a method forming a container having a base member with opposed walls and an interior that is capable of storing items below a top plate member for supporting objects exterior to the container; with the top plate member extending into grooves of the opposed walls and being slidable on rollers, with respect to the base member without disturbance to any objects supported thereon, to expose and allow access to the interior. The top plate member can form a plurality of separate sections that are moveable away from each other.

15 Claims, 4 Drawing Sheets

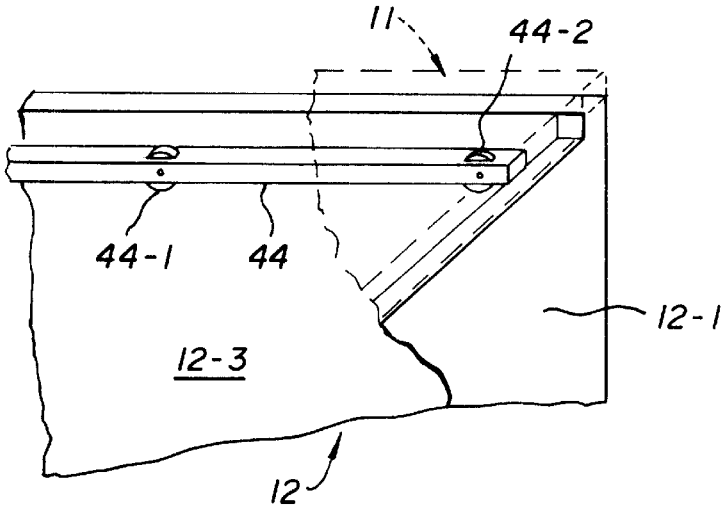
Fig. 4A
Fig. 4B
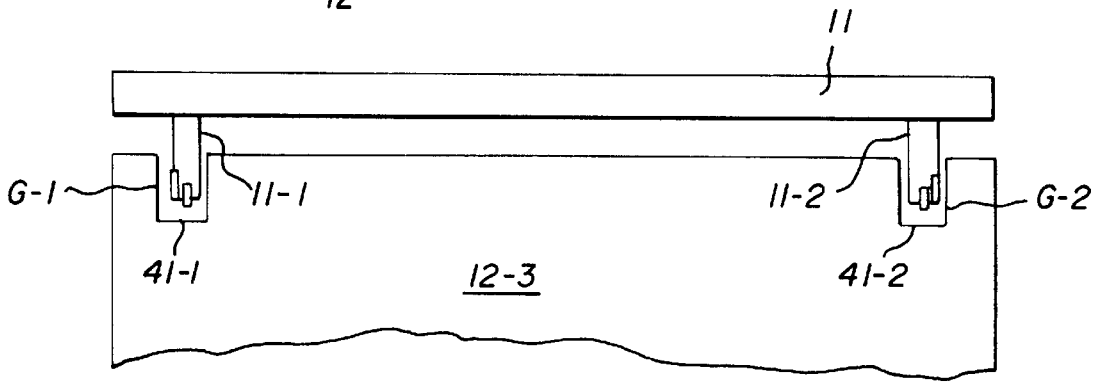
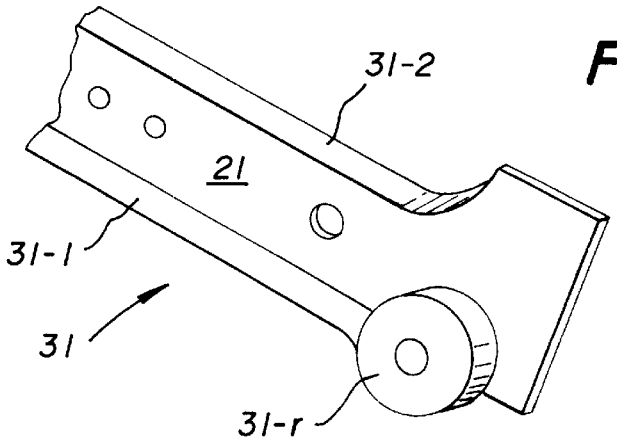
Fig. 4C

CONTAINER METHOD AND APPARATUS

This invention relates to containers, and more particularly to containers that can serve as furniture.

BACKGROUND OF THE INVENTION

Containers are is characterized by having a movable member that allows access to an interior compartment for storage. Some containers have a slab-like top that can be opened. When such a container is closed, the slab-like top can be used to support objects that are removed when the container is to be opened.

Some containers with slab-like tops are supported by legs, and form container tables. Various kinds of container tables have been developed for many different uses. Examples include breakfast, bedside and card container tables; coffee, console, concertina (folding), dining, dressing, library (writing), side (dessert), sofa (lamp) and tea container tables.

When the legs of such tables are removed, they serve as storage chests.

Small, rudimentary containers, constructed of metal or wood, were known to the earliest recorded civilization of the Sumerians in the area of what is now know as Iraq. The culture of the Sumerians passed to the Babylonians and then to the Assyrians. Subsequently the Egyptians were exposed to this culture and produced small containers of fine workmanship with graceful designs and slab-like tops.

The Greeks inherited the Egyptian civilization and developed further forms of containers with slab-like tops. The supporting structure for the slab-like tops was architectural in character and of considerable variety, beautifully proportioned and fashioned from marble, metals, and inlaid woods. These materials were frequently decorated with relief carvings and paintings with ornamental motifs borrowed from architectural forms.

The Romans next brought container construction to an even greater degree of development in marble and metals, as shown by examples found at excavations at Pompeii and Herculaneum. In addition to simple containers entirely of metal or wood, there are ornamented examples that are delicately carved and inlaid with ivory and precious metals. Where the containers are provided with legs, they are formed with sphinxes, wings of griffins, fluted columns, or carved to resemble the legs of rams or lions.

Since it was the Roman custom to recline at dining, rather than sit in Greek fashion, many Roman tables also served as containers, with a low height. But because of their expense, tables in ancient times were owned only by the rich.

In the Middle Ages and Renaissance containers became primitive, although there were circular, oval, and oblong examples. Generally, the containers has flat-board tops covered with a tablecloths that could extend to the floor.

Virtually all containers of the Gothic period were of oak, massive in proportions and sturdily built. Their ornamentation was almost entirely of small-scale carved architectural motifs, such as tracery, pointed arches, and finials on sides supporting slab-like tops.

During the Italian Renaissance containers were made in all sizes, generally in rectangular form, with flat tops made of single planks of walnut. Small containers frequently had flat, hexagonal and octagonal tops.

In Spain, containers between 1500 to 1650 were of Italian design, with tops having plain, square-cut edges.

In the 16th century some containers became jointed or framed together as permanent items of furniture, and were known as "joyned" or "framed" containers, generally of oak.

Elizabethan containers in England had the merit of extreme solidity. Storage containers were strongly constructed of stout timbers and slabs of oak joined with wooden pegs. Nails were not used to avoid corrosion from rust. The style remained unchanged for a century boards joined to form flat, slab-like tops.

By the Restoration in England in 1660, the small walnut storage container had developed into forms of varying sizes and shapes, including those with a hinged top.

From the 17th to 19th Centuries, beginning during the reign of Louis XIV from 1643–1715, French taste became the standard of excellence in Europe. Containers with flat marble tops were extravagantly gilded, inlaid with tortoise shell, metals, and rare woods. In England, containers in solid silver were produced during the reign of Charles II from 1660–1685, and for Versailles during the reign of Louis XIV.

Mahogany came into general use during the 18th century, and a wide variety of "occasional" storage tables were developed for such refinements in living as tea drinking and gaming. Examples include the card table, tea table and bedside table, as free adaptations of earlier models in walnut.

In addition there were two types of dressing table for storage: the poudreuse, at which the hair was powdered, and the coiffeuse, at which the hair was dressed. Both the poudreuse and coiffeuse had hinged flat tops with a mirror fitted beneath, but in the coiffeuse the mirror was flanked with containers for various cosmetics.

As the 18th century proceeded, dressing tables grew increasingly elaborate, being fitted with bookrests, for letter writing, for use in bed and even for use in dining. In England, the master furniture maker, Thomas Chippendale (about 1718 to 1779), introduced tea tables with open fretwork galleries and designs taken from Gothic and Chinese sources. Near the end of the 18th century designs in mahogany were superseded by the highly elaborate designs of George Hepplewhite and Thomas Sheraton in satinwood and rosewood. Their designs had flat, marble tops.

In the 19th century mahogany tables developed in England in Regency style, and in France in Empire style had turning legs and brass mountings, as precursors of the later Victorian and Restoration styles.

In the 20th century table storage furniture continues to be characterized by having a flat, slab-like top. Various kinds of storage containers and storage tables have been developed for different uses.

Accordingly, it is an object of the invention to increase the facility with which containers and storage table can be used, while provide both novel aesthetic appeal and utility.

Another object of the invention is to achieve a new style of container furniture which is easy and economical to manufacture.

A further object of the invention is to present a novel style in containers generally and container furniture in particular.

SUMMARY OF THE INVENTION

In accomplishing the foregoing and related objects, the invention provides a container formed by a base member having an interior that is capable of storing items and a top member that is capable of supporting objects that are exterior to the container, with the top member being slidable with respect to the base member, without disturbance to any objects supported thereon. The slide movement of the top member exposes the interior thereof and allow access thereto.

In accordance with one aspect of the invention, the container has a base member that is proportioned to slidably receive the top member, and includes opposing walls which are adapted to slidably receive the top member.

The base member can be a quadrilateral with opposed walls, and the top member is slidably receivable within grooves of the opposed walls. A support can adjoin each of the grooves for supporting the top member. The support can include rollers for promoting the slidable movement of the top member.

The top member can be a unitary or composite structure and be formed from a plurality of separate sections, which can be oppositely slidable to expose the interior of the base member.

In a method of the invention for fabricating a container having an exterior and interior storage capability, the steps include (a) providing a base for the interior storage of items; and (b) slidably affixing to the base a support member for the exterior storage of items; whereby access to interior storage can be made by slidably moving the support member without disturbing any items supported thereby.

The method can include the step of fabricating a container wherein the base member is a quadrilateral with pairs of opposing walls, and the support member is planar and slidably receivable by the quadrilateral, which includes wall supports for said planar support member.

The quadrilateral can include wall-mounted rollers to facilitate the slidable movement of the support member.

In a method of the invention for storing items interiorly and exteriorly, the steps include (a) placing items for storage within a container; and (b) placing other items upon a slidable cover of the container; whereby there can be access to the interior of the container without disturbance to the other items by the slidable movement of the cover.

The other items can be positioned on a planar top member that serves as a slidable cover for the container, which can have quadrilateral walls by which the cover is slidably received.

In the method of of the invention for storing items, the cover can serve as the complete closure for the container, which can include rollers to facilitate the movement thereof from one position to another.

The slidable cover can have a plurality of sections which are slidably moveable away from one another to expose the interior of the container.

DESCRIPTION OF THE DRAWINGS

Other aspects of the invention will become apparent after considering several illustrative embodiments, taken in conjunction with the drawings, in which:

FIG. 4A is partial perspective view, with a portion cut away, showing one form of roller support for the slidable top of the invention;

FIG. 4B is an alternative support arrangement for the slidable top of the invention;

FIG. 4C is a perspective view of the glide member employed in the alternative support of FIG. 4B;

DETAILED DESCRIPTION

Figure 1B:
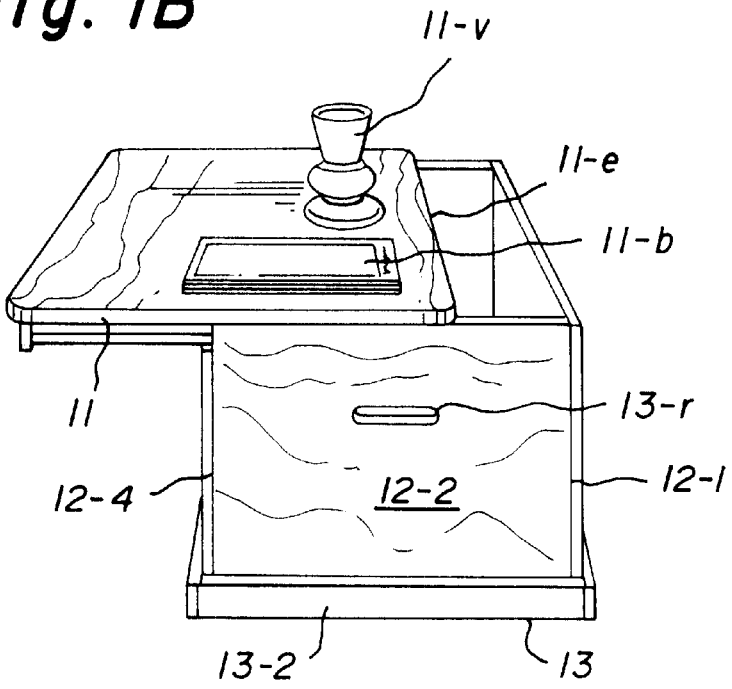
FIG. 1B is a photograph of the container of FIG. 1A with the top, including the stored items, retracted by sliding to expose the interior of the container where other items can be stored.
Figure 1A:
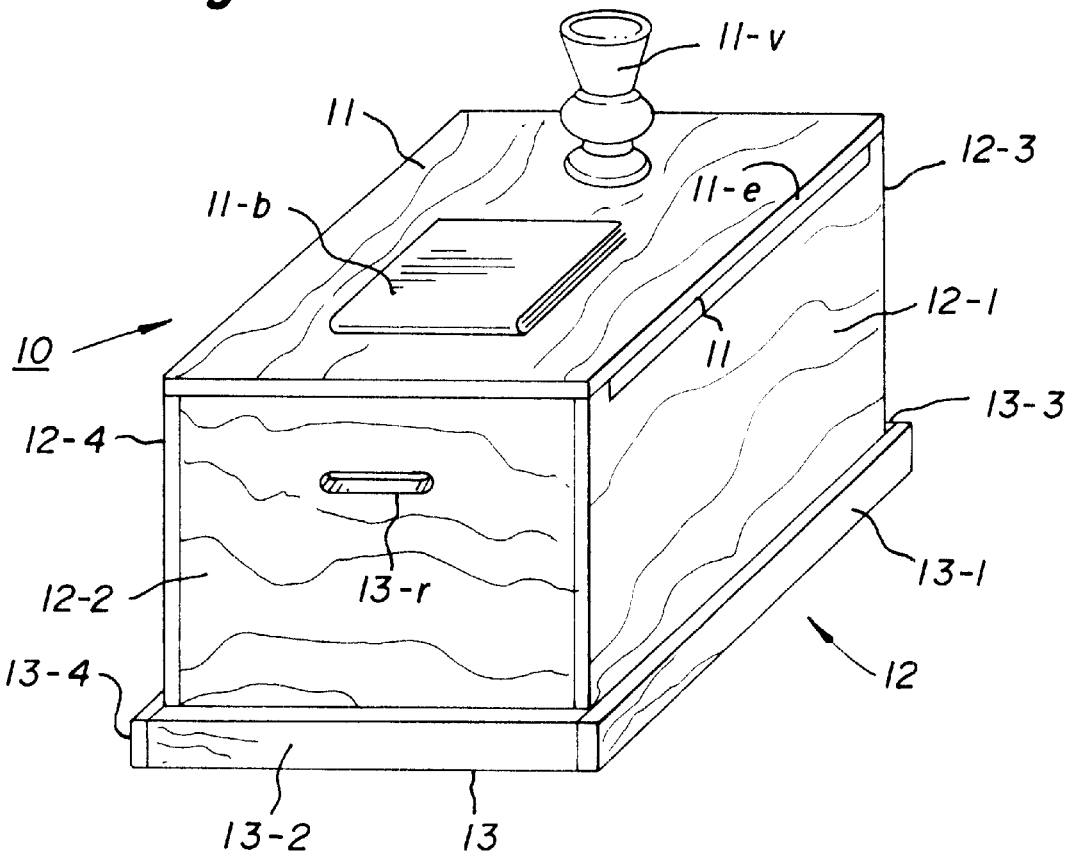
FIG. 1A is a perspective view of a slidable top container in accordance with the invention, with items stored on the top of the container.

With reference to the drawings FIG. 1A shows a container 10 in accordance with the invention wherein a top member 11 holds a book 11-*b* and a vase 11-*v*.

The top member 11 is slidably received by a quadrilateral box 12 formed by a frontal panel 12-1, a left side panel 12-2, a real panel 12-3 and and right side panel 12-4. The base 13 of the box 12 is surrounded by legs 13-1 though 13-4. Both the left and right panels include a hand grip recess 13-*r*, of which only the recess in the left panel 12-2 is visible in FIG. 1A.

The invention permits access to the interior of the box 12 by slidable movement of the top 11as shown in FIG. 1B, without disturbance to the book 11-*b* and the vase 11-*v*. This slidable movement of the top 11 is achieved by pushing on the edge 11-*e* in FIG. 1A, so that the top 11 slides, as explained below, to a desired position, such as that shown in FIG. 1B.

Figure 2A:
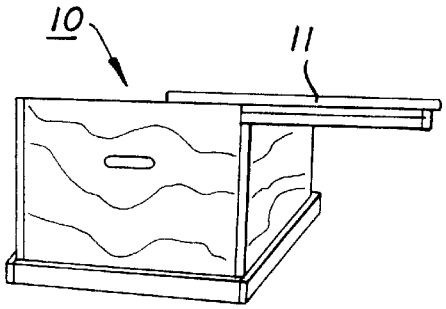
FIG. 2A is a photograph of the container of FIG. 1A with the top, including the stored items, retracted by sliding, in a direction opposite to that shown in FIG. 1B, to expose the interior of the container where other items can be stored.
Figure 2B:
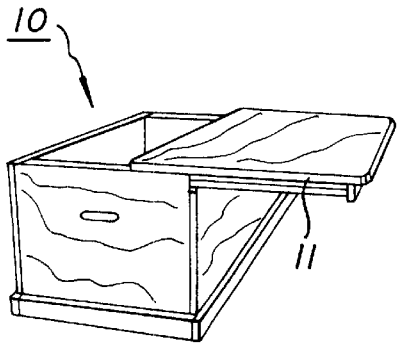
FIG. 2B is a photograph of the container of FIG. 2A with the top, including the stored items, positioned to provide a better view of the exposed interior of the container where other items can be stored.

As indicated in FIG. 2A, the top 11 has been moved, by sliding, in a direction opposite to that shown in FIG. 1A, to expose the interior of the container where other items can be stored, as more clearly indicated in FIG. 2B.

Figure 3A:
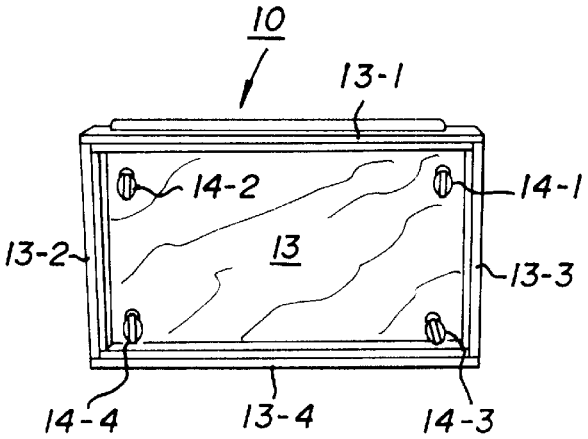
FIG. 3A is a photograph of the bottom of the container of FIGS. 1A and 2A.

In FIG. 3A the bottom of the container of FIGS. 1A and 2A is shown with a base 13, legs 13-1 though 13-4, and casters 14-1 through 14-4 to facilitate rolling the container 10 to any other desired position, which can be undertaken with the top 11 opened and any objects thereon in position.

Figure 3B:
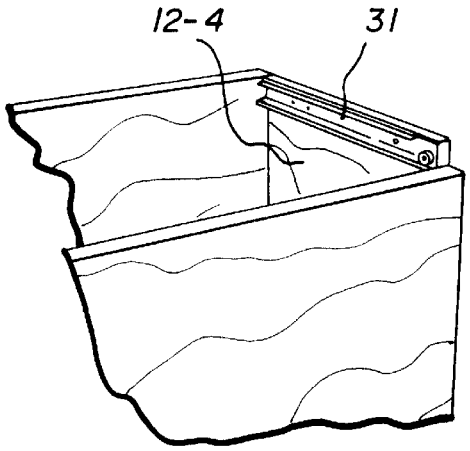
FIG. 3B is a photograph of the container of FIGS. 1A and 2A with the top completely removed.

In FIG. 3B top 11 has been completely removed, showing a right-side glide 31, shown in detail in FIG. 5C, affixed to the right-hand side wall 12-4. In the arrangement of FIG. 3B, the top 11 has it edge that engages the glide 31 appropriately grooved so that the top can move slidably along the glide 31.

Another form of roller support for the slidable top 11 of the invention is shown in the partial perspective view of FIG. 4A. Instead of the glide 31, a bar 44 with rollers 44-1 and 44-2 is attached to the side wall 12-3. The slidable top 11 is shown in phantom.

Still another alternative support arrangement for the slidable top of the invention is shown in FIG. 4B, the back wall 12-3 has slots 41-1 and 41-2 for stems 11-1 and 111-2 of the top 11. The top is shown elevated away from the back wall 12-3 for clarity, with glides G-1 and G-2 on the stems 11-1 and 11-2.

FIG. 4C is a partial perspective view of the glide member 31 employed in the support of FIG. 3B and the alternative support of FIG. 4B. The glide 31 has a roller 31-*r* at an end 31-*e*, and the glide 31 has upper and lower rails 31-1 and 31-2 bounding a mounting strip 21.

Figure 5A:
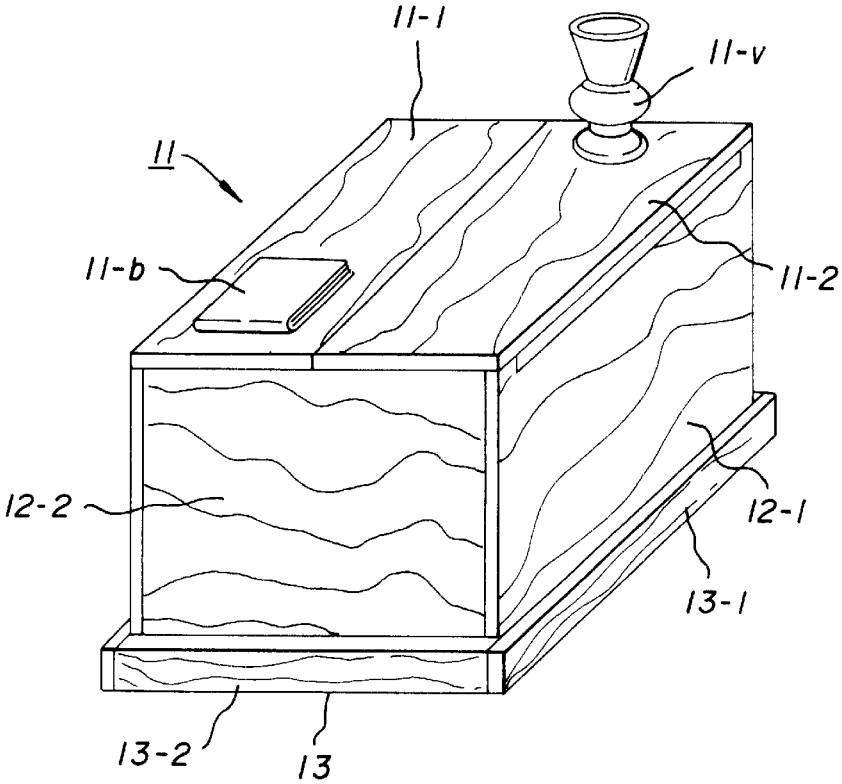
FIG. 5A is a perspective view of an alternative slidable top container in accordance with the invention, with items stored on the top of the container.
Figure 5B:
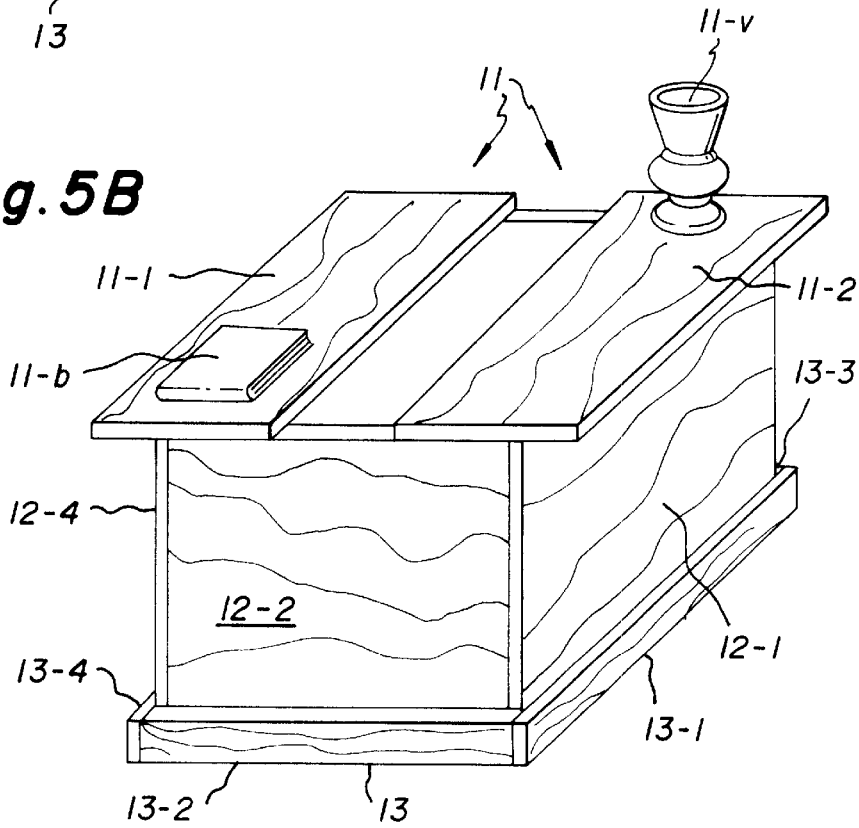
FIG. 5B is a perspective view of the container of FIG. 5A with the top bi-directionally separated to expose the interior of the container, with the top stored items remaining in position on the respective parts of the separated top sections.

While the top 11 of FIGS. 1A though 4B is unitary, the top can be in separately slidable sections as shown in Fig. 5B, where a section 11-1 has been slidably separated from a section 11-2 to expose the interior of the container, with the top stored items remaining in position on the respective parts of the separated top sections. After the storage function has been completed the sections 11-1 and 11-2 are returned to their closed positions as shown in FIG. 5A.

It will be appreciated that although the sections 11-1 and 11-2 are slidable with respect to the front and back walls 12-1 and 12-3, sections 11-1' and 11-2' (not shown) can be used which are slidable with respect to the side walls 12-2 and 12-4.

It will be understood that the foregoing detailed description is for illustration only and that various modifications and adaptations of the invention can be made without departing from the spirit and scope of the invention as defined in the appended claims.

What is claimed:

1. A container comprising a base member having opposed walls and an interior that is capable of storing items; and a top plate member that is capable of supporting objects that are exterior to said container;

said top member extending into grooves of said opposed walls and being slidable with respect to said base member, without disturbance to any objects supported thereon, to expose the interior thereof and allow access to said interior;

wherein said base member is proportioned to slidably receive said top member with a support adjoining each of said grooves for supporting the top member, and said support includes rollers for promoting the slidable movement of said top member.

2. A container in accordance with claim 1 wherein said base member includes opposing walls which are adapted to slidably receive said top member and said base member is surrounded by legs, with said opposed walls having hand grip recesses.

3. A container in accordance with claim 2, wherein said base member is a quadrilateral with opposed walls, said top member is slidably receivable within grooves of said opposed walls, side glides are affixed to said opposed walls, and said top member has edges that engages said glides in grooves so that said top member can move slidably along said glides.

4. A container in accordance with claim 3, further including a support adjoining each of said grooves for supporting said top member, and said support has rollers.

5. A container in accordance with claim 2 wherein said support includes rollers for promoting the slidable movement of said top member, and container has a back wall with slots for stems of said top member with glides on said stems.

6. A container in accordance with claim 1, wherein said top member is a unitary plate structure and said container has a back wall with slots for stems of said top member, with glides on said stems.

7. A container comprising a base member having opposed walls and an interior that is capable of storing items; and a top plate member that is capable of supporting objects that are exterior to said container;

said top member extending into grooves of said opposed walls and being slidable with respect to said base member, without disturbances to any objects supported thereon, to expose the interior thereof and allow access to said interior;

wherein said top member comprises a plurality of separate sections movable away from each other.

8. A container in accordance with claim 7 wherein said sections abut each other and are oppositely slidable to expose the interior of said base member.

9. The method of fabricating a container having an exterior and interior storage capability, which comprises the steps of:

(a) providing a base for the interior storage of items; and (b) slidably affixing to said base a support member that extends into said base for the exterior storage of items;

whereby access to interior storage can be made by slidably moving said support member without disturbing any items supported thereby;

wherein said base member is a quadrilateral with pairs of opposing walls, and said support member is a planar plate slidably receivable by said quadrilateral; and said quadrilateral includes wall-mounted rollers to facilitate the slidable movement of said support member.

10. The method of storing items interiorly and exteriorly, which comprises the steps of (a) placing items for storage within a container; and (b) placing other items upon a slidable cover plate that extends into said container; whereby there can be access to the interior of said container without disturbance to said other items by the slidable movement of said cover.

11. The method of storing items in accordance with claim 10, wherein said other items are positioned on a planar top member that serves as a slidable cover for said container.

12. The method of storing items in accordance with claim 10, wherein said container has quadrilateral walls and said cover is slidably received thereby.

13. The method of storing items in accordance with claim 12, wherein said cover serves as the complete closure for said container.

14. The method of storing items accordance with claim 10, wherein said container includes rollers to facilitate the movement thereof from one position to another.

15. The method of storing items in accordance with claim 10, wherein said slidable cover has a plurality of sections which are in abutting contact and slidably moveable away from one another to expose the interior of said container.

* * * * *